US010038960B2

(12) United States Patent
Beyfuss et al.

(10) Patent No.: US 10,038,960 B2
(45) Date of Patent: Jul. 31, 2018

(54) HEARING AID AND PLUG-IN CONNECTION FOR SAME

(71) Applicant: SIVANTOS PTE. LTD., Singapore (SG)

(72) Inventors: Stefanie Beyfuss, Erlangen (DE); Holger Kral, Erlangen (DE); Bjoern Freels, Erlangen (DE); Hartmut Ritter, Erlangen (DE)

(73) Assignee: Sivantos Pte. ltd., Singapore (SG)

( * ) Notice: Subject to any disclaimer, the term of this patent is extended or adjusted under 35 U.S.C. 154(b) by 0 days.

(21) Appl. No.: 15/049,304

(22) Filed: Feb. 22, 2016

(65) Prior Publication Data

US 2016/0249142 A1 Aug. 25, 2016

(30) Foreign Application Priority Data

Feb. 23, 2015 (DE) ..... 10 2015 203 203

(51) Int. Cl.
*H04R 25/00* (2006.01)
*G10K 11/22* (2006.01)

(52) U.S. Cl.
CPC ..... *H04R 25/556* (2013.01); *G10K 11/22* (2013.01); *H04R 25/402* (2013.01); *H04R 25/604* (2013.01); *H04R 25/608* (2013.01); *H04R 2225/021* (2013.01)

(58) Field of Classification Search
CPC .. H04R 25/556; H04R 25/402; H04R 25/604; H04R 25/608; H04R 2225/021; G10K 11/22
USPC ..... 381/324
See application file for complete search history.

(56) References Cited

U.S. PATENT DOCUMENTS

| | | | | |
|---|---|---|---|---|
| 5,204,917 A * | 4/1993 | Arndt | H04R 25/608 | 381/324 |
| 7,016,512 B1 * | 3/2006 | Feeley | H04R 25/608 | 381/322 |
| 8,442,252 B2 * | 5/2013 | Meosky | H04R 25/65 | 381/322 |
| 9,332,356 B2 * | 5/2016 | Finlay | H04R 25/00 | |
| 2011/0194718 A1 * | 8/2011 | Ratay | H04R 19/005 | 381/330 |
| 2012/0063621 A1 * | 3/2012 | Naumann | H04R 25/60 | 381/323 |
| 2012/0189149 A1 * | 7/2012 | Finlay | H04R 25/608 | 381/328 |

(Continued)

FOREIGN PATENT DOCUMENTS

| | | |
|---|---|---|
| DE | 202013000547 U1 | 2/2013 |
| EP | 1816893 A1 | 8/2007 |

(Continued)

*Primary Examiner* — Oyesola C Ojo
(74) *Attorney, Agent, or Firm* — Laurence A. Greenberg; Werner H. Stemer; Ralph E. Locher

(57) ABSTRACT

A hearing aid, in particular a behind-the-ear hearing aid, has a housing to be worn behind an ear of a user, and a receiver which, in order to transmit sound to the ear, is connected to a sound tube having a housing-side end on which a plug connector is arranged. The plug connector is connected releasably to the housing. The hearing aid is characterized in that the plug connector contains a holder for the receiver, and the receiver is a component part of the plug connector.

9 Claims, 3 Drawing Sheets

(56) References Cited

U.S. PATENT DOCUMENTS

| | | | | |
|---|---|---|---|---|
| 2013/0004005 | A1* | 1/2013 | Barth | H04R 25/556 381/330 |
| 2013/0121501 | A1* | 5/2013 | Jeong | F02M 35/125 381/71.5 |
| 2013/0279728 | A1* | 10/2013 | Chan | H04R 25/608 381/324 |
| 2013/0294628 | A1* | 11/2013 | Higgins | H04R 25/556 381/322 |
| 2014/0003638 | A1* | 1/2014 | Barth | H04R 25/556 381/314 |
| 2014/0205120 | A1* | 7/2014 | Barth | G10K 11/22 381/322 |

FOREIGN PATENT DOCUMENTS

| | | | | |
|---|---|---|---|---|
| EP | 2654322 | A2 | 10/2013 | |
| WO | 2004025990 | A1 | 3/2004 | |
| WO | 2011101041 | A1 | 8/2011 | |
| WO | 2016055109 | A1 | 4/2016 | |
| WO | WO 2016055109 | A1 * | 4/2016 | H04R 25/604 |

* cited by examiner

HEARING AID AND PLUG-IN CONNECTION FOR SAME

CROSS-REFERENCE TO RELATED APPLICATION

This application claims the priority, under 35 U.S.C. § 119, of German patent application DE 10 2015 203 203.5, filed Feb. 23, 2015; the prior application is herewith incorporated by reference in its entirety.

BACKGROUND OF THE INVENTION

Field of the Invention

The invention relates to a hearing aid, in particular a behind-the-ear hearing aid, with a housing to be worn behind an ear of a user, and with a receiver which, in order to transmit sound to the ear, is connected to a sound tube having a housing-side end on which a plug connector is arranged, the plug connector being connected releasably to the housing.

Such a hearing aid is described in published, European patent application EP 2 654 322 A2, corresponding to U.S. Pat. No. 9,204,228, for example.

A hearing aid usually has a housing with a number of microphones arranged therein for recording noises from the environment, and a receiver, that is to say a loudspeaker, by which the recorded noises are output, particularly in amplified form. In addition, an electrical circuit is usually present for processing the recorded noises before they are output via the receiver.

If the hearing aid is what is called a behind-the-ear hearing aid, the housing is worn by a user, that is to say a person wearing the hearing aid, usually behind the ear in relation to the viewing direction of the user. In such hearing aids, there are in principle two known variants as regards the positioning of the receiver. In a first variant, the receiver is accommodated and secured in the housing. In this case, the noises generated by the receiver are guided from the housing to or into the ear by what is called a sound tube, or simply a tube. The sound tube is basically a hose-like or channel-like hollow body, which is often connected releasably to the housing by a plug connector. By contrast, in a second variant, referred to as a receiver-in-canal behind-the-ear hearing aid, the receiver is fitted directly in the ear and is connected to the housing via a cable.

Depending on the extent of the hearing loss suffered by the user, the latter requires a receiver of a suitable performance class, that is to say with a defined output power, wherein receivers with a higher output power typically also have larger dimensions than receivers of a lower performance class. In particular, it is also possible that the extent of the hearing loss changes with time and replacement of the receiver is therefore necessary. Behind-the-ear hearing aids in which the receiver is accommodated in the housing offer more possibilities of choice than receiver-in-canal behind-the-ear hearing aids, since the choice of receiver in the latter is additionally limited by the size of the ear. However, replacement of the receiver in behind-the-ear hearing aids is often difficult, since the receiver is firmly connected to the housing and/or the housing is awkward to open in order to replace the receiver.

SUMMARY OF THE INVENTION

The object of the invention is to make available an improved hearing aid which is particularly simple to handle and is particularly versatile in use. Moreover, a suitable plug connector for the hearing aid is to be made available.

The hearing aid is in particular a behind-the-ear hearing aid and contains a housing to be worn behind an ear of a user, and a receiver, that is to say in particular a loudspeaker, which is connected to a sound tube in order to transmit sound to the ear. The sound tube in turn has a housing-side end on which a plug connector is arranged, the plug connector being connected releasably to the housing. The plug connector contains a holder for the receiver, wherein the receiver is a component part of the plug connector.

An important advantage of the invention is in particular that the receiver is in particular firmly connected to the plug connector and not to the housing, as a result of which, by pulling out the plug connector, the receiver can be removed particularly easily from the housing and replaced. Thus, for example, a faulty receiver is particularly easy to replace, without the user having to procure a completely new housing. Moreover, by virtue of the plug-in connection, the hearing aid is particularly easy to handle and the receiver is particularly easy to separate from the housing.

The releasable connection between the plug connector and the housing means there is accordingly a releasable connection between the receiver and the housing. This advantageously affords increased versatility of use of the housing since the latter, depending on the plug connector attached, can be used both as a behind-the-ear hearing aid, with the receiver in the housing, and also as a receiver-in-canal behind-the-ear hearing aid. In order to change between these two configurations, a corresponding module simply has to be plugged onto the housing. This module then either contains a plug connector, in which a receiver is arranged, and a sound tube attached thereto, or, in the case of a receiver-in-canal behind-the-ear hearing aid, a plug connector by which a cable is routed to a receiver to be inserted into the ear. In this way, the user is afforded the possibility of changing between several types of hearing aids in a particularly versatile and cost-effective manner.

The housing of the hearing aid has, for example, a slightly curved shape and is in particular designed to be worn behind the ear, i.e. in particular behind the ear and slightly above the auditory canal. The housing thus has an underside, which then bears on the ear, and a top face directed away from the ear. The housing moreover has an inner face and an outer face, wherein the inner face bears on the user's head, and the outer face is accordingly directed outward as seen from the user's head.

In order to record surrounding noises, the housing accommodates a number of microphones, for example two microphones, which are preferably arranged one behind the other in the viewing direction of the user and approximately at the same height. In order to achieve a particularly optimal result as regards the recording of noises, one of the microphones is arranged as a front microphone in a farthest forward position of the housing, and a further microphone serving as a rear microphone is arranged behind this in the viewing direction. In order in particular to permit such an arrangement, the plug connector can preferably be plugged onto the underside of the housing or plugged into the latter. In addition, in order to be able to transport the greatest possible output power to the ear, the plug connector is also positioned as far forward as possible, and for example underneath the microphone, as a result of which the receiver can also be accordingly positioned particularly close to the ear.

The housing additionally contains in particular an electronic circuit with an electronics system serving to process the signals generated by the microphones. For example, the signals are filtered and/or amplified by the electronics system. The electronics system also serves in particular for conditioning the signals to be output via the receiver. The electronics system is expediently arranged on a printed circuit board, which is mounted in particular fixedly in the housing. For the power supply, a battery in particular is provided, which is likewise accommodated in the housing. The housing further contains in particular a number of control elements, by which the hearing aid can be suitably configured by the user.

A sound tube is connected either releasably or fixedly to the plug connector. Here, a sound tube is understood in particular as any hose-like or channel-like element for guiding sound. It is preferably a tube or a bow with an elongate hollow space for guiding sound. The sound tube additionally has two ends, wherein the end connected to the plug connector is a housing-side end, and the other end is an ear-side end. The latter is guided in particular to the auditory canal and is either placed near this onto the ear or is even inserted into the auditory canal.

The plug connector contains a holder in which the receiver is held and in particular fixed. For example, the holder is shaped like a pot or tongs and at least partially encloses the receiver. In a particularly simple and cost-effective design, the plug connector and the holder are in one piece and in particular are formed as a plastics injection molding. In a suitable variant, the receiver has a substantially cylindrical design and is fixed in the axial direction and/or radial direction in the holder.

For a particularly stable arrangement of the receiver in the holder, a corresponding latching mechanism or click mechanism is provided, for example. Alternatively, the receiver is adhesively bonded or soldered in the holder or suitably secured in another way. In particular, on account of the receiver being fixed in the holder, the receiver is thus a component part of the plug connector. The plug connector with the receiver, and with a sound tube attached thereto, then forms a module that is particularly easy to exchange.

In order at the same time to ensure a releasable connection and also an optimal stability in the connected state, a corresponding locking mechanism is preferably provided, by which the plug connector can be locked relative to the housing. For example, the locking mechanism is for this purpose configured as a latch connection or by a locking pin. In this way, accidental separation of the plug connector is advantageously avoided. To permit release, the locking mechanism is then correspondingly released and the plug connector can be separated from the housing. When the plug connector is released, the receiver advantageously remains in the holder and is accordingly easy to separate from the housing.

In one suitable embodiment, the plug connector contains a number of contact elements for producing a number of electrical connections to a number of contact elements of the housing. In this way, it is possible in particular to achieve a signaling link from the receiver to the housing. In other words, it is possible, by the respective contact elements, for the noise recorded by the microphone or the microphones to be conveyed to the receiver via a corresponding electrical connection in order to be converted there to an acoustic signal. When the plug connector is released from the housing, the electrical connections are then accordingly interrupted too. The respective contact elements are in this case made from an electrically conductive material and, for example, are configured as metalized surfaces. Particularly in this context, it is advantageous if the plug connector is configured as a MID component, that is to say an injection-molded circuit carrier, since in this way the plug connector can be produced in a cost-effective manner as a robust and in particular one-piece plastics part with contact elements mounted directly thereon.

In a preferred development, the holder has a number of receiver contacts for attachment of the receiver. Particularly in this embodiment, it is then advantageously possible that an electrical signal, transmitted from the housing to the plug connector via the contact elements, can be looped through to the receiver. For example, the contact elements are likewise arranged on the holder in such a way that, when the latter is connected to the housing, these contact elements are connected to an electronics system correspondingly provided in the housing and are connected in the plug connector to the receiver contacts. In other words, the contact elements are connected to the receiver contacts in a suitable manner for looping through an electrical signal transmitted from the housing to the receiver. The receiver contacts are then arranged in particular in the holder, for example on the bottom thereof, and the receiver is held in such a way that its connection contacts are connected to the receiver contacts. In a suitable alternative, the receiver contacts are configured as spring contacts between which the receiver is at the same time securely held and thus fixed. In addition or as an alternative, the receiver is expediently soldered onto the receiver contacts by its connection contacts, resulting in a particularly stable integration in the plug connector.

In an advantageous embodiment, the receiver contains a number of contact elements for producing a number of electrical connections to a number of contact elements of the housing. In this embodiment, it is in particular possible to produce a connection between the receiver and the housing directly, i.e. without having to divert the electrical signal that is to be transmitted. In particular, it is then advantageously possible to dispense with a printed circuit board or electronics system additionally arranged in the plug connector. Alternatively, however, a design is also conceivable in which a number of contact elements are arranged both on the receiver and also on other parts of the plug connector, in order to permit a corresponding connection to the housing.

Preferably, the receiver is reversibly insertable into the holder, as a result of which the receiver is particularly easily exchangeable in respect of the module composed of plug connector, receiver and sound tube. In this way, it is then possible for a user to exchange only the receiver and to continue using the remaining part of the plug connector and the sound tube. As a result of this modular configuration, the versatility of handling of the hearing aid as a whole is greatly improved. Moreover, the receiver can also be exchanged as an individual part by the user, while the other components of the hearing aid are further used.

In order to achieve a particularly compact design of the hearing aid and in particular of the housing, the plug connector, in the connected state, sits in a recess in the housing. This is understood in particular as meaning that the plug connector, in the inserted state, is accommodated completely in the housing, and it accordingly has an outer face that forms a part of the housing. In particular, the outer face is directed outward with respect to the housing and is preferably flush with the surface of the housing, i.e. the outer face is adapted to an outer contour of the housing.

Preferably, the plug connector is arranged underneath a front microphone, resulting in a particularly short path to the auditory canal, such that the output power made available by the receiver is optimally utilized.

In a preferred embodiment, the plug connector is arranged on an underside of the housing. Particularly with such positioning, an arrangement of the receiver as close as possible to the auditory canal is possible, with the front microphone at the same time in a correspondingly farthest forward position with respect to the housing. Moreover, a hearing aid configured in this way is particularly compact. Furthermore, in particular in this embodiment, the outer face of the plug connector bears on the user's ear, such that, in combination with the aforementioned adaptation of the outer face to the outer contour of the housing, greatly improved wearing comfort is achieved.

In a suitable variant, the plug connector has mirror symmetry with respect to a plane that extends in a vertical direction and in a viewing direction of the user. In other words, the housing has an inner face and an outer face, wherein the inner face bears on the user's head and the outer face is accordingly directed outward, as seen from the user's head, and wherein the two faces are mirror-symmetrical to each other. Preferably, the housing is in the same way mirror-symmetrical with respect to its surface and outer contour. In this way, the versatility of use of the hearing aid is advantageously improved since it can be worn by the user both on the left and also on the right. The symmetrical configuration also advantageously permits a cost reduction in production, since only one type of plug connector, in particular only one type of housing, has to be produced, which is then usable for both sides.

To further improve the versatility of the hearing aid, particularly as regards replacement of the receiver, the hearing aid is advantageously configured for the attachment of different plug connectors with receivers of different dimensions. In this way, it is readily possible for a user, when changing the receiver for one of another performance class, to continue using the same housing. The plug connector is then in each case configured in such a way that it can be fitted with receivers of different dimensions, i.e. different performance classes. For this purpose, corresponding recesses and/or free spaces are in particular provided in the housing and are then available to accommodate the receiver according to the space requirement thereof.

Other features which are considered as characteristic for the invention are set forth in the appended claims.

Although the invention is illustrated and described herein as embodied in a hearing aid and a plug-in connection for same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
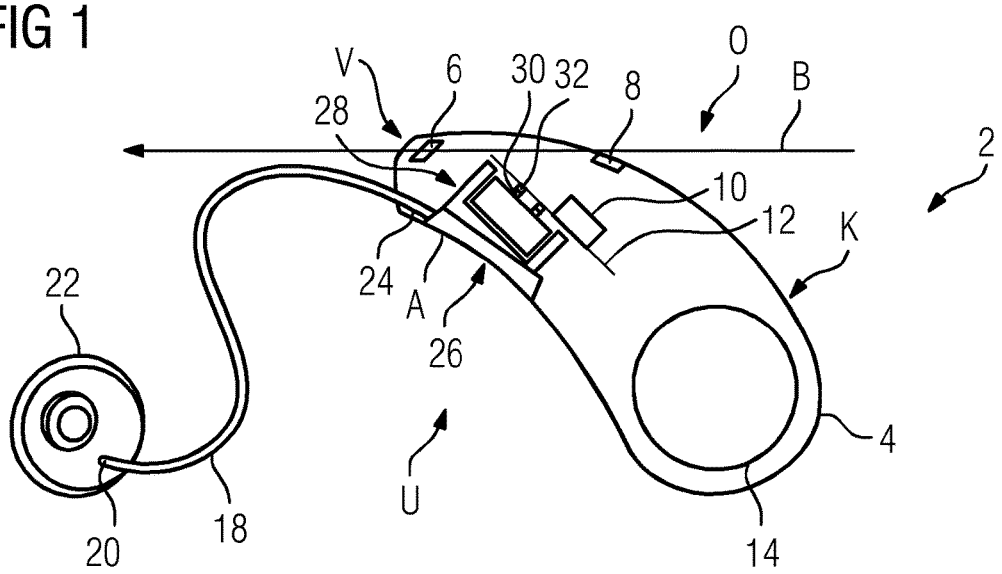
FIG. 1 is a diagrammatic, side view of a hearing aid with a housing and with a plug connector connected thereto according to the invention.

Referring now to the figures of the drawings in detail and first, particularly to FIG. 1 thereof, there is shown a hearing aid 2 in a side view, in which an interior of the hearing aid 2 is also shown. The hearing aid 2 here is what is called a behind-the-ear hearing aid, containing a housing 4 that can be worn by a user (not shown here) behind one of his or her ears. Thus, the hearing aid 2 here contains several microphones 6, 8, wherein one is a front microphone 6 and one is a rear microphone 8. The two microphones 6, 8 are arranged one behind the other with respect to a viewing direction B of the user (not shown here), wherein the front microphone 6 is arranged forward on the housing 4 in the viewing direction B, in particular at a farthest forward location V. The housing 4 moreover has a top face O which is directed upward with respect to the user and on which the rear microphone 8 is arranged. Opposite the top face O, the housing 4 has an underside U which bears on the user's ear during use.

The microphones 6, 8 each serve for recording surrounding noise, i.e. for converting sound to electrical signals. The latter are sent to an electronics system 10 likewise arranged inside the housing 4. For this purpose, the microphones 6, 8 are connected, in a manner not shown here, to a printed circuit board 12 on which the electronics system 10 is arranged. For power supply, the hearing aid 2 shown here additionally contains a battery 14, which in particular is also connected to the printed circuit board 12.

For acoustic output, i.e. to reproduce the recorded noises, the hearing aid 2 contains a receiver 16 which, in the embodiment shown here, is positioned inside the housing. The noises output from the receiver 16 are coupled into a sound tube 18 and are transported by the latter to the user's ear. In the configuration shown here, an earpiece 22 is mounted on an ear-side end 20 of the sound tube 18 and can be inserted into the auditory canal of the user. The sound signal generated by the receiver 16 is then coupled in at a housing-side end 24 of the sound tube 18.

The sound tube 18 is not connected to the housing 4 directly, but instead via a plug connector 26 which here sits in a corresponding recess 28 of the housing 4. The plug connector 26 has an outwardly directed outer face A which, in the embodiment shown here, is configured in such a way that it lies flush with an outer contour K of the housing 4. The plug connector 26 thus sits completely in the housing 4 and does not protrude outward, which in particular improves the wearing comfort of the hearing aid 2.

Figure 2:
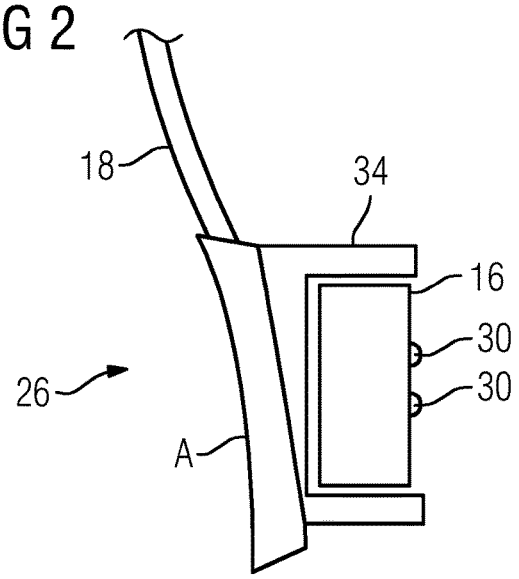
FIG. 2 is an enlarged illustration showing the plug connector according to FIG. 1.

The plug connector 26 according to FIG. 1 is shown in an enlarged view in FIG. 2. To ensure that the electrical signals generated by the microphones 6, 8 in conjunction with the electronics system 10 can be forwarded to the receiver 16, the latter is electrically connected to the printed circuit board 12. In the variant shown in FIG. 1, the receiver 16 for this purpose has several contact elements 30 which, in the connected state, are connected to corresponding contact elements 32 of the printed circuit board 12. The contact elements 30, 32 are configured as spring contact connections, for example. The receiver 16 is thus electrically connected directly to the housing 4.

It is also clear from FIG. 2 that the receiver 16 is held in a holder 34 of the plug connector 26. The holder is designed here with two arms, between which the receiver 16 is arranged.

Figure 3:
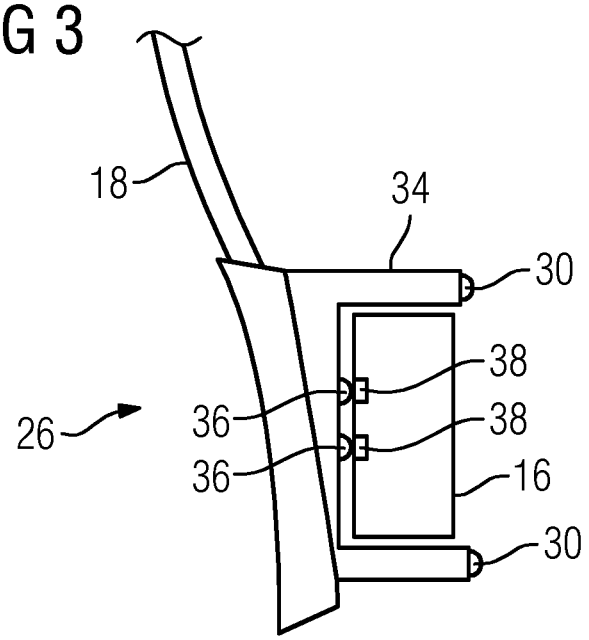
FIG. 3 is an illustration showing a variant of the plug connector.

FIG. 3 shows an alternative design of the plug connector 26 in which the receiver 16 is not electrically connected directly to the housing 4 but only indirectly via the contact elements 30, which are here arranged on the holder 34 and are connected to corresponding contact elements 32 (not shown here) of the printed circuit board. The contact elements 30 of the plug connector 26 are each connected in turn to receiver contacts 36, which are electrically connected to corresponding mating contacts 38 of the receiver 16. In other words, the electrical signals from the printed circuit board 12 are firstly looped through the holder 34 and then routed via the receiver contacts 36 to the receiver 16.

Figure 4:
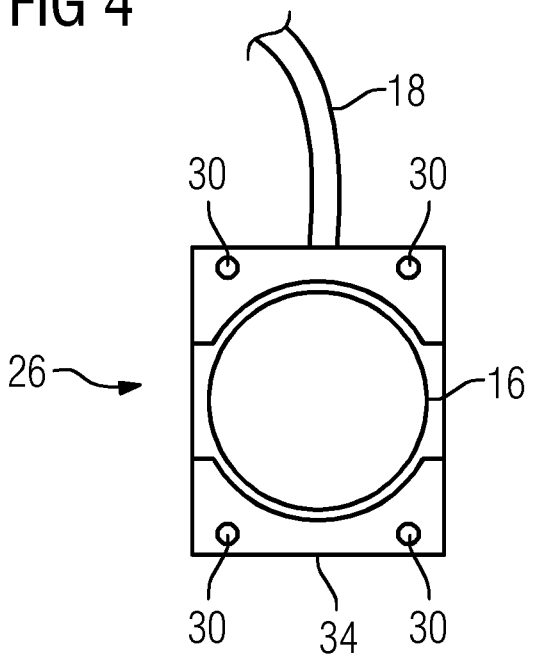
FIG. 4 is an illustration showing the plug connector according to FIG. 3 in another view.

The plug connector 26 shown in an enlarged side view in FIG. 3 is shown in FIG. 4, by contrast, in a front view. The latter clearly shows the holder 34, which is here designed in part in the form of a pot and has two arms between which the receiver 16 is arranged and in particular also fixed by fixing elements not shown here. The contact elements 30 are arranged on the top of the holder 34, i.e. on the side facing inward with respect to the housing 4. By contrast, the receiver contacts 36 (not visible here) are positioned on the bottom of the holder 34.

Figure 5:
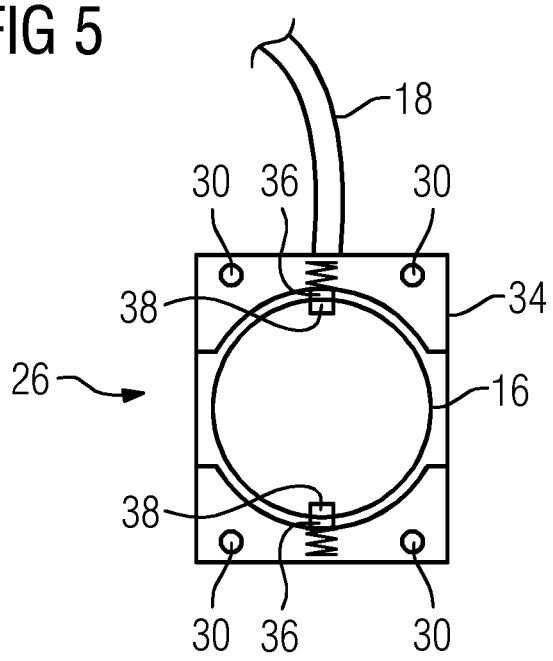
FIG. 5 is an illustration showing a further variant of the plug connector.
Figure 6:
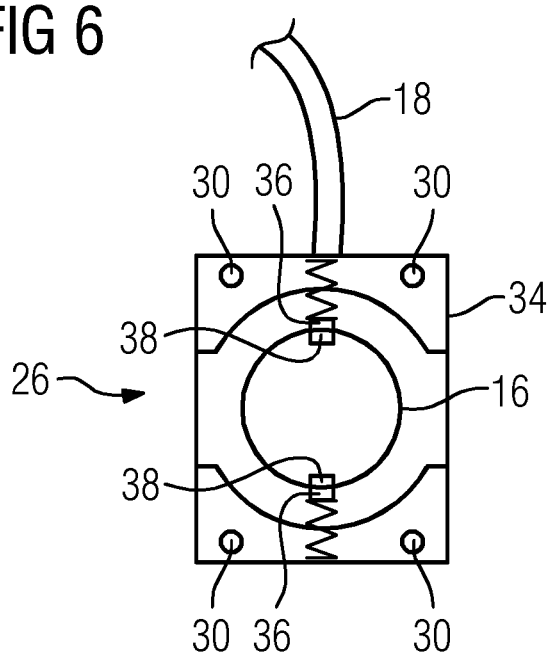
FIG. 6 is an illustration showing the plug connector according to FIG. 5 with an alternative receiver.

FIGS. 5 and 6 show a further variant of the plug connector 26, in which the receiver 16 is fixed by two mutually opposite receiver contacts 36 which are designed as spring contacts. The receiver 16 shown in FIG. 6 moreover belongs to a lower performance class than the receiver 16 in FIG. 5 and has accordingly smaller dimensions, i.e. in particular a smaller diameter here. However, by virtue of the receiver contacts 36 being designed as spring contacts, this smaller receiver 16 is also easy to insert into the holder 34 and to fix in the latter. By contrast, in an alternative configuration, such fixing is dispensed with and, instead, the receiver 16 is, for example, soldered onto the receiver contacts 36. To replace the receiver 16, the latter is then accordingly unsoldered and an alternative receiver 16 is soldered on. In this way, it is also possible for various receivers 16 of different performance classes to be inserted into the holder 34 and used with the same housing 4.

The receiver 16 is generally a component part of the plug connector 26. When releasing the plug connector 26 and removing it from the housing 4, the respective receiver 16 is accordingly also released with it. Moreover, the plug connector 26 with the receiver 16 and with the sound tube 18, and in particular also with the earpiece 22, forms an independent module that can be replaced by an alternative module. In this way, very different modules can be attached to the housing 4 in accordance with the needs of the user. Thus, the same housing 4 can be used for modules with different receivers 16, different sound tubes 18 and/or different earpieces 22. Moreover, it is also possible to use modules in which the receiver 16 is not a component part of the plug connector 26 but instead is arranged at the ear-side end 20 of the sound tube 18, for example in the earpiece 22. In this way, the same housing 4 can be used both for conventional behind-the-ear hearing aids 2 and also for receiver-in-canal behind-the-ear hearing aids (not shown here).

The invention claimed is:

1. A hearing aid, comprising:

a housing to be worn behind an ear of a user and having a plurality of contact elements;

a sound tube having a housing-side end;

a receiver which, in order to transmit sound to the ear, is connected to said sound tube; and a plug connector disposed on said housing-side end of said sound tube, said plug connector being connected releasably to said housing, said plug connector having a holder for said receiver, and said receiver is a component part of said plug connector, said plug connector further having a plurality of contact elements for producing a plurality of electrical connections to said plurality of contact elements of said housing.

2. A hearing aid, comprising:

a housing to be worn behind an ear of a user;

a sound tube having a housing-side end;

a receiver which, in order to transmit sound to the ear, is connected to said sound tube;

a plug connector disposed on said housing-side end of said sound tube, said plug connector being connected releasably to said housing, said plug connector having a holder for said receiver, and said receiver is a component part of said plug connector; and said holder having a plurality of electrical contacts for contacting to said receiver, said holder further having a plurality of contact elements and said receiver is not electrically connected directly to said housing but only indirectly via said contact elements, so that electrical signals from said housing are first looped through said holder and then routed via said electrical contacts to said receiver.

3. A hearing aid, comprising:

a housing to be worn behind an ear of a user and having a plurality of contact elements;

a sound tube having a housing-side end;

a receiver which, in order to transmit sound to the ear, is connected to said sound tube, said receiver having a plurality of contact elements for producing a plurality of electrical connections to said number plurality of contact elements of said housing; and a plug connector disposed on said housing-side end of said sound tube, said plug connector being connected releasably to said housing, said plug connector having a holder for said receiver, and said receiver is a component part of said plug connector.

4. The hearing aid according to claim 1, wherein said receiver is reversibly insertable into said holder.

5. The hearing aid according to claim 1, wherein:

said housing has a recess formed therein; and said plug connector, in a connected state, is disposed in said recess in said housing.

6. The hearing aid according to claim 1, further comprising a front microphone, said plug connector is disposed underneath said front microphone.

7. The hearing aid according to claim 1, wherein said plug connector is disposed on an underside of said housing.

8. The hearing aid according to claim 1, wherein the hearing aid is configured for an attachment of different plug connectors with receivers of different dimensions.

9. The hearing aid according to claim 1, wherein the hearing aid is a behind-the-ear hearing aid.

* * * * *